United States Patent [19]

Fujioka et al.

[11] 3,989,514

[45] Nov. 2, 1976

[54] HEAT-RESISTING AUSTENITIC STAINLESS STEEL

[75] Inventors: Tokio Fujioka; Masayuki Kinugasa; Shozo Iizumi; Shizuhiro Teshima; Isamu Shimizu, all of Shin-Nanyo, Japan

[73] Assignee: Nisshin Steel Co., Ltd., Tokyo, Japan

[22] Filed: Mar. 25, 1975

[21] Appl. No.: 561,813

[30] Foreign Application Priority Data

July 25, 1974 Japan ..... 49-84622

[52] U.S. Cl. ..... 75/124; 75/122; 75/128 R; 75/128 C; 75/128 E; 75/128 G; 75/128 T; 75/128 Z

[51] Int. Cl.[2] ..... C22C 38/48; C22C 38/50

[58] Field of Search ..... 75/124, 128 C, 128 E, 75/128 G, 128 Z, 128 T, 128 R, 122; 148/38

[56] References Cited

UNITED STATES PATENTS

| | | | |
|---|---|---|---|
| 2,553,330 | 5/1951 | Post et al. | 75/128 E X |
| 3,754,898 | 8/1973 | McGurty | 75/128 E X |
| R24,242 | 12/1956 | Lohr | 75/128 E |

FOREIGN PATENTS OR APPLICATIONS

| | | | |
|---|---|---|---|
| 46-39581 | 8/1967 | Japan | 75/128 C |

*Primary Examiner*—Arthur J. Steiner
*Attorney, Agent, or Firm*—Ladas, Parry, Von Gehr, Goldsmith & Deschamps

[57] ABSTRACT

An austenitic stainless steel comprising not more than 0.15% by weight of C, 1.5 – 4.0% by weight of Si, not more than 2% by weight of Mn, 17.0 – 30.0% by weight of Ni, 24.0 – 32.0% by weight of Cr, 0.5 – 2.5% by weight of Al, 0.001 – 0.100% by weight of Ca, 0.001 – 0.100% by weight of at least one rare earth metal, 0 – 1.0% by weight of at least one of Ti, Zr, Hf, Nb and Ta, and balance Fe and incidental impurities is disclosed. Steels of this class are superior to the known high Si oxidation-resisting austenitic stainless steels in scaling and nitriding resistance and with stand prolonged use under the circumstances where the steels undergo cyclic heating to high temperatures.

3 Claims, No Drawings

HEAT-RESISTING AUSTENITIC STAINLESS STEEL

BACKGROUND OF THE INVENTION

This invention relates to a class of novel heat-resisting austenitic stainless steels provided with high resistance to oxidation, nitriding and carburization at high temperatures, which are suitable for use in high temperature atmosphere or under the condition where the steels undergo continuous or cyclic heating.

Nowadays legal regulations on automobile exhaust gases are being enacted and stainless steels of various kinds are attracting the interest of technical people as a heat-resisting steel material for exhaust gas cleaning systems. And it is considered that as the materials for manufacturing after-burner, thermal reactor, etc., which are exposed to remarkably high temperatures among the exhaust gas cleaning apparatuses, austenitic stainless steels are the most suitable from the viewpoint of strength at high temperatures and workability at room temperature.

Materials which have been studied for the above-mentioned purpose include ferritic materials such as Fe-Cr-Al alloys, austenitic stainless steels such as Type 310 and more expensive materials such as Incolloy 800 (TM), etc. Among these materials, the Fe-Cr-Al alloys are excellent in resistance to scaling and superior in resistance to thermal fatigue, but they are inferior in high temperature strength and thus are liable to deformation, and that they are poor in weldability and workability, and today these materials are regarded as unemployable. On the other hand, the Type 310 steels are of most interest at present because of their excellent properties, although they are a little inferior to the Fe-Cr-Al alloys in resistance to scaling and to thermal fatigue.

However, when austenitic steels such as the Type 310 steels are cyclicly heated in the atmosphere or burning gases, oxides scale is formed, which easily spalls and peels off and the steels rapidly reduce thickness. Also they suffer nitriding due to nitrogen existing in the ambient atmosphere. The nitriding induces precipitation of a large amount of chromium nitride in the steels and rapidly reduces their scaling resistance by decreasing the amount of effective chromium in the steel, making the prolonged use of the steels impossible.

Therefore, it is an urgent need to develop inexpensive heat-resisting austenitic stainless steels which are capable of prolonged use with scaling resistance. Under these circumstances, we studied the effects of addition of Si, Al, Ca and rare earth metals to the austenitic heat-resisting steels, and have found that addition of a light amount of Ca and rare earth metals in combination with Si and Al to said steels promotes formation of homogeneous internal oxide comprising $SiO_2$ and $Al_2O_3$ in the substrate, which provides the steels with excellent resistance to scaling and nitriding. Thus we have created this invention.

Prior to this invention, high Si heat-resisting austenitic stainless steels are known and existed in the industrial standards in various countries as AISI 302B (18Cr-9Ni-2.5Si), AISI 314 (25Cr-20Ni-2Si), DIN 4828 (20Cr-12Ni-2Si), etc. Although these known steels are excellent where they are continuously heated at a high temperature and are superior in nitriding resistance, their shortcomings are that their oxide scale spalls and peels off when they are subjected to cyclic heating, and therefore nitriding easily proceeds therein. The heat-resisting austenitic stainless steels that contain up to several percents of Al and a slight amount of Ca and rare earth metals have somewhat improved scaling resistance, but nitriding resistance is not improved when Si content of this level. Therefore the scaling resistance of these steels is rapidly degraded.

As we stated above, combined addition of Si, Al and a slight amount of Ca and rare earth metals remarkably improves scaling resistance when the steels undergo cyclic heating to high temperatures and simultaneously improves nitriding resistance thereof.

The class of austenitic stainless steels according to this invention essentially comprises: not more than 0.15% by weight of C, 1.5 – 4.0% by weight of Si, not more than 2.0% by weight of Mn, 17.0 – 30.0 by weight of Ni, 24 – 32% by weight of Cr, 0.5 – 2.5% by weight of Al, 0.001 – 0.100% by weight of Ca, 0.001 – 0.100% by weight of at least one rare earth metal with the balance being Fe and impurities inevitably incidental in the manufacturing of the steels. The steels may further contain 0.05 – 1.0% by weight of at least one of Ti, Zr, Hf, Nb and Ta.

In the composition of the novel steel of this invention:

Carbon (C) is an austenite former and, at the same time, it is a significant element to obtain high temperature strength. But too high content C makes cold and hot workability of the steel difficult. So the C content is restricted to not more than 0.15%. (Hereinafter in this specification, all the percentages are by weight unless specifically stated otherwise.) Preferably, C is contained in an amount not more than 0.12%, more preferably, not more than 0.1%.

Silicon (Si) is an important element that improves high temperature oxidation resistance and resistance to nitriding and carburizing. To obtain the effect of combination with Al, at least 1.5% of Si is necessary. However, Si in excess of 4.0% does not bring about improvement in proportion to the content and impairs hot and cold workability. The preferred Si content is 1.5 – 3.5% and more preferably 1.5 – 3%.

Manganese (Mn) is an austenite former and thus addition thereof contributes to saving of Ni. But this element impairs oxidation resistance of the steel at high temperatures. Therefore in the steel of this invention, Mn is contained in the amount normally found in the ordinary heat-resisting steels, that is, not more than 2%. Preferred Mn content is not more than 1.5% and more preferably not more than 1.0%.

Nickel (Ni) is one of the fundamental elements of austenitic stainless steels. This element has the effect of preventing nitriding during heating the steel, too. Ni must be contained in an amount not less than 17.0% in order to maintain the austenitic structure in the presence of the proper amount of Si and Al in combination. However, the upper limit of Ni content is defined as 30.0% from the economic viewpoint. The preferred range of Ni content is 19 – 27% more preferably 21 – 25%.

Chromium (Cr) is the most fundamental element of the stainless steel, which provides the steel with high temperature oxidation resistance. Less than 24.0% of Cr does not exhibit such effect sufficiently, but, if the Cr content is in excess of 32%, a large amount of delta ferrite is formed in the presence of Si and Al, and therefore an increased amount of Ni is required to balance the composition, which makes the steel more expensive. The preferred Cr content range is 25 – 30%. The more preferred range is 25 – 27%.

Aluminum (Al) is an important element to give excellent scaling resistant to the steel. At least 0.5% of Al is necessary in order to exhibit such effect. But if this element is contained in a large amount, workability of the steel is impaired and a further amount of Ni is required to maintain the balance in the composition. Therefore Al is contained in the range of 0.5 – 2.5%. The preferred content range is 0.5 – 2.3%, the more preferred range is 0.5 – 2.0%.

Calcium (Ca), incorporated in a slight amount in the steel, has an effect of promoting formation of homogeneous internal oxide layer comprising $SiO_2$ and $Al_2O_3$ inside the substrate when the steel is heated at high temperatures in an oxidative atmosphere. As the result, outward diffusion of metal cations is inhibited, and thus oxidation resistance is markedly improved. Simultaneously, nitriding is inhibited, too. Not less than 0.001% of Ca is required, but more than 0.100% of Ca practically is not dissolved in the steel. The preferred content range is 0.001 – 0.06% and the more preferred range is 0.001 – 0.03%. Although Ca is usually used, this can be replaced by magnesium (Mg), strontium (Sr) or barium (Ba).

The composition of high Si steels such as that of this invention are designed so that several % (by volume) of delta ferrite is formed in the welding beads in order to reduce sensitivity of the steel to hot cracking in welding. Therefore, a small amount of ferrite remains, which causes cracking during hot working. Addition of at least one of rare earth metals such as yttrium (Y), cerium (Ce), lanthanum (La), etc. is effective for prevention of cracking of this kind. Also rare earth metals are effective as well as Ca for improvement in high temperature oxidation resistance. Especially they are effective for improvement of resistance and inhibition of nitriding. In order to bring about those effects, they must be contained in the steel in an amount of 0.001 – 0.100%. The preferred range is 0.005 – 0.1% more preferably 0.005 – 0.08%.

Titanium (Ti), zirconium (Zr), hafnium (Hf), niobium (Nb) and tantalum (Ta) form stable carbides and nitrides and therefore they are effective in enhancing high temperature strength. These elements form stable nitrides and therefore prevent formation of AlN and retain Al in the effective solid solution state. These elements should be contained in an amount of 0.05 – 1.00%. The preferred range is a 0.05 – 0.7% and the preferably 0.05 – 0.5%.

Of course the steels of this invention inevitably contain incidental impurities. Of such impurities, sulfur (S) must not exist in excess of 0.04%. The content must preferably be not more than 0.03% and more preferably not more than 0.02%. Phosphorus (P) must not be present in excess of 0.05%, preferably it must be not more than 0.04%, more preferably not more than 0.035%.

The steel of this invention is far improved in scaling resistance over the known high Si austenitic stainless steels, and further it is characterized in that nitriding does not easily proceed. Also the steel of this invention is more economical in comparison with the known steels of the similar kinds.

DETAILED DESCRIPTION OF THE INVENTION

Now the invention is illustrated by way of working examples. Sample heats of some commercially available steels (mentioned as Commercial Steels hereinafter), comparative steels (mentioned as Comparative Steels hereinafter) and steels of this invention (mentioned as Invention Steels hereinafter) are prepared and made into test pieces as follows.

Mild steel scrap was melted together with ferrochromium, ferronickel, etc. and was decarbonized in an Heroult type arc furnace. Calcium and rare earth metals were added in the tapping stage in the form of calcium-silicon and rare earth metal-calcium-silicon and/or mixed rare earth metals such as Mischmetal. The effective use rate was about 10% for Ca, and 20 – 40% for rare earth elements. (In the large scale production, the steel of this invention can be produced by the vacuum oxygen decarbonization process or the argon oxygen decarbonization process using a converter. In any process, calcium and rare earth metals are added in the last tapping stage.)

The molten steel was poured into ingot cases to obtain 7-ton ingots. The ingots were soaked and were made into slabs by means of a slab-forming mill. The formed slabs were subjected to the surface grinding, and were heated in a slab furnace at 1150° – 1250° C for 5 hours, and were made into hot coils by hot rolling. The hot coils were annealed and pickeled, and then cold-rolled to 2 mm thickness. The cold-rolled sheet was finally annealed at 1010° – 1150° C for 1 – 5 minutes and quenched.

Test specimens for tensile test were cut out of the thus obtained sheet. They were 2 mm in thickness, 12.5 mm in width and 50 mm in gauge length with enlarged end portions. Creep rupture test specimens were made from the slabs which had been heated at 1010° – 1150° C for about 1 hour and was quenched. The creep rupture test specimens were 6 mm in diameter and 30 mm in gauge length with enlarged end portions 12.5 mm in diameter.

The chemical analyses of these steel samples are summarized in Table 1.

Comparative Steels 1 – 3 are of the same compositions as the steels of this invention except that they do not contain Ca and rare earth metals. Comparative Steel 4 contains Ca and rare earth metals, but its Si content is low.

These samples were subjected to 500 cycles of heating at 1100° C or 1200° C for 25 minutes and air-cooling for 5 minutes and oxidation weight loss was measured (in $mg/cm^2$). Also nitrogen in the steels was quantitatively analyzed and percentage of nitriding was obtained. The results are shown in Table 2.

As seen in this table, Comparative Steels 2 and 3 are superior to Commercial Steels in that oxidation weight loss is less and scaling resistance is better. That is, Comparative Steels 2 and 3, which contain rather high percentage of Si and Al, exhibit better scaling resistance. Comparative Steel 4, which contains a rather low percentage of Si, rather high percentage of Al, and a small amount of Ca and rare earth metals, is provided with considerably high scaling resistance. But both Commercial Steels and Comparative Steels suffer remarkably nitriding during heating and a large amount of $Cr_2N$ (or CrN), AlN, etc. are precipitated. Thus the amounts of Cr and Al that are effective for preventing formation of scale decrease rapidly and thus the scaling resistance is rapidly degraded. Invention Steels, in which Si and Al are contained in rather high percentages together with a small amount of Ca and rare earth metals, have an enhanced scaling resistance in comparison with Commercial Steels and Comparative Steels, and progress of nitriding is markedly retarded. Thus Invention Steels retain stable scaling resistance over a prolonged time of use.

The steel of this invention may further contain a suitable amount of at least one of Ti, Zr, Hf, Nb and Ta in order to enhance high temperature strength of the steel. The results of the tensile test (at 800° C and 1000° C) and the creep rupture test (in 300 hours and 1000 hours) are shown in Table 3. As learned from this table, Invention Steels 4 and 5, which contain some of Ti, Zr, Hf, Nb and Ta, are superior to the other Invention Steels and Commercial Steels in high temperature strength.

Although the invention was explained with respect to preferred embodiments thereof, it should be understood that various modifications can be carried out within the scope as defined in the attached claims and the spirit of this invention.

Table 1

Chemical Analyses of Steel Samples (% by weight)

| | C | Si | Mn | Ni | Cr | Al | Ca | R.E.* | Others |
|---|---|---|---|---|---|---|---|---|---|
| Type 310 | 0.07 | 0.79 | 1.58 | 19.50 | 24.85 | — | — | — | — |
| Incolloy 800 | 0.04 | 0.65 | 0.95 | 31.26 | 19.71 | 0.46 | — | — | Ti 0.46 |
| Comparative Steel | | | | | | | | | |
| - 1 | 0.06 | 3.30 | 0.85 | 15.04 | 23.05 | — | — | — | — |
| " - 2 | 0.06 | 1.61 | 0.95 | 18.05 | 23.24 | 1.46 | — | — | — |
| " - 3 | 0.06 | 2.18 | 1.00 | 20.79 | 25.15 | 0.96 | — | — | — |
| " - 4 | 0.07 | 0.61 | 1.44 | 23.35 | 24.06 | 2.15 | 0.009 | 0.037 | — |
| Invention Steel | | | | | | | | | |
| - 1 | 0.07 | 2.16 | 0.88 | 18.06 | 24.08 | 0.82 | 0.009 | 0.050 | — |
| " - 2 | 0.08 | 2.14 | 0.95 | 20.10 | 25.65 | 0.85 | 0.010 | 0.047 | — |
| " - 3 | 0.08 | 2.98 | 0.97 | 19.82 | 24.21 | 1.44 | 0.013 | 0.056 | — |
| " - 4 | 0.10 | 1.66 | 0.97 | 24.00 | 26.52 | 2.25 | 0.010 | 0.044 | Ti=0.10 Nb=0.12 |
| " - 5 | 0.06 | 2.18 | 0.99 | 23.70 | 26.21 | 1.37 | 0.013 | 0.052 | Ti=0.11 Nb=0.10 |

*Total amount of rare earth metals

Table 2

Oxidation weight loss, analysis of nitrogen and nitriding percentage after cyclic heat

| | 1100° C | | | 1200° C | | |
|---|---|---|---|---|---|---|
| | Oxidation weight loss (mg/cm²) | Nitrogen content (%) | Nitriding* | Oxidation weight loss (mg/cm²) | Nitrogen content (%) | Nitriding* |
| Type 310 | 78.5 | 0.126 | 5.6 | 280.0 | 0.416 | 19.8 |
| Incolloy 800 | 80.5 | 0.093 | 6.8 | — | — | — |
| Comparative Steel | | | | | | |
| - 1 | 88.5 | 0.077 | 1.4 | 295.0 | 0.208 | 5.3 |
| " - 2 | 32.5 | 0.231 | 3.0 | 180.3 | 0.582 | 8.1 |
| " - 3 | 45.5 | 0.215 | 2.5 | 129.5 | 0.576 | 7.2 |
| " - 4 | ** | 0.228 | 2.2 | 130.0 | 0.570 | 7.1 |
| Invention Steel | | | | | | |
| - 1 | ** | 0.063 | 0.4 | 18.1 | 0.122 | 1.7 |
| " - 2 | ** | 0.087 | 0.4 | 15.2 | 0.175 | 1.8 |
| " - 3 | ** | 0.072 | 0.3 | 38.2 | 0.135 | 1.5 |
| " - 4 | ** | 0.122 | 1.0 | 20.4 | 0.181 | 2.1 |
| " - 5 | ** | 0.104 | 0.4 | 19.5 | 0.185 | 1.5 |

*Nitriding percentage = (nitrogen content after test − nitrogen content before test) ÷ nitrogen content before test
**These samples should oxidation weight gain of 2 – 4 mg/cm²

Table 3

High temperature strength

| | Tensile test at 800° C | | Tensile test at 1000° C | | Creep rupture strength at 800° C | |
|---|---|---|---|---|---|---|
| | Tensile strength (Kg/cm²) | Elongation (%) | Tensile strength (Kg/cm²) | Elongation (%) | 300 hrs. (Kg/cm²) | 1000 hrs. (Kg/cm²) |
| Invention Steel | | | | | | |
| - 2 | 19.1 | 100 | 6.3 | 151 | 4.6 | 3.7 |
| " - 3 | 20.2 | 97 | 7.5 | 124 | 4.5 | 3.9 |
| " - 4 | 24.3 | 68 | 10.5 | 62 | 5.8 | 5.1 |
| " - 5 | 23.4 | 65 | 10.0 | 64 | 5.5 | 4.9 |
| Type 310 | 22.3 | 54 | 8.5 | 73 | 4.9 | 4.2 |

What we claim is:

1. A heat-resisting austenitic stainless steel consisting essentially of not more than 0.15% by weight of C, 1.5 – 4.0% by weight of Si, not more than 2% by weight of Mn, 17.0 – 30.0% by weight of Ni, 24.0 – 32.0% by weight of Cr, 0.5 – 2.5% by weight of Al, 0.001 – 0.100% by weight of Ca, 0.001 – 0.100% by weight of at least one rare earth metal, 0 – 1.0% by weight of at least one of Ti, Zr, Hf, Nb and Ta and balance Fe and incidental impurities.

2. The heat-resisting austenitic stainless steel as claimed in claim 1, consisting essentially of not more than 0.12% by weight of C, 1.5 – 3.5% by weight of Si, not more than 1.5% by weight of Mn, 19 – 27% by weight of Ni, 25 – 30% by weight of Cr, 0.5 – 2.3% by weight of Al, 0.001 – 0.06% by weight of Ca, 0.005 – 0.1% by weight of at least one rare earth metal, 0.05 – 0.7% by weight of at least one of Ti, Zr, Hf, Nb and Ta and balance Fe and incidental impurities.

3. The heat-resisting austenitic stainless steel as claimed in claim 2, consisting essentially of not more than 0.1% by weight of C, 1.5 – 3.0% by weight of Si, not more than 1.0% by weight of Mn, 21 – 25% by weight of Ni, 25 – 27% by weight of Cr, 0.5 – 2.3% by weight of Al, 0.001 – 0.03% by weight of Ca, 0.005 – 0.08% by weight of at least one rare earth metal, 0.05 – 0.5% by weight of at least one of Ti, Zr, Hf, Nb and Ta and balance Fe and incidental impurities.

* * * * *